US011317485B2

(12) United States Patent
Mao et al.

(10) Patent No.: US 11,317,485 B2
(45) Date of Patent: Apr. 26, 2022

(54) LIGHT EMITTING CONTROL CIRCUIT OF KNOB

(71) Applicant: NINGBO AGSUN PRODUCTS, INC., Zhejiang (CN)

(72) Inventors: Xuefei Mao, Zhejiang (CN); Xianghua Liu, Zhejiang (CN); Bin Shen, Zhejiang (CN)

( * ) Notice: Subject to any disclaimer, the term of this patent is extended or adjusted under 35 U.S.C. 154(b) by 0 days.

(21) Appl. No.: 17/245,597

(22) Filed: Apr. 30, 2021

(65) Prior Publication Data

US 2022/0007475 A1 Jan. 6, 2022

(30) Foreign Application Priority Data

Jul. 3, 2020 (CN) ..... 202021293135.9

(51) Int. Cl.
*H05B 45/20* (2020.01)
*F21V 23/04* (2006.01)

(52) U.S. Cl.
CPC ..... *H05B 45/20* (2020.01); *F21V 23/0442* (2013.01)

(58) Field of Classification Search
None
See application file for complete search history.

(56) References Cited

U.S. PATENT DOCUMENTS 7,771,293 B1 * 8/2010 Vann ..... A63B 69/0071 473/422
2013/0076465 A1 * 3/2013 Hernandez-Oliver ..... B60Q 1/441 335/205
2016/0353542 A1 * 12/2016 Orr ..... H05B 47/11

* cited by examiner

*Primary Examiner* — Dedei K Hammond

(57) ABSTRACT

The utility model discloses a light emitting control circuit of a knob, which includes a first Hall switch, a moving magnet that controls the on-off of the first Hall switch, and a second Hall switch, wherein the moving magnet can move above the circumference where the first Hall switch is located, the first Hall switch is connected to a first light emitting group, an output of the first Hall switch is connected to a second light emitting group through a control switch, the second Hall switch is connected to a third light emitting group, and changes of colors such as two and three colors are achieved by changing the position of the moving magnet between the first Hall switch and the second Hall switch.

11 Claims, 3 Drawing Sheets

LIGHT EMITTING CONTROL CIRCUIT OF KNOB

FIELD OF THE INVENTION

The utility model belongs to the field of household appliance fittings, and particularly relates to a light emitting control circuit of a knob.

BACKGROUND OF THE INVENTION

Household kitchen appliances basically need to be switched on/off or adjusted through knobs. As household kitchen appliances, barbecue grills are mainly used for family or outdoor gatherings. With the increase in outdoor activities, barbecue grills are more and more popular with people. Since it is not easy to check the state of a knob on a control panel at night or in case of insufficient light, monochromatic or bi-colored LED lights are generally mounted on knobs as state indications on the current market. However, two-color or color-changing schemes are mostly realized by using mechanical microswitches, and the mechanical schemes exhibit poor service life and reliability. Therefore, it is very important to obtain a light emitting control circuit of a knob that can overcome the above defects.

SUMMARY OF THE INVENTION

In order to solve the above technical problems, the utility model provides a light emitting control circuit of a knob, which includes a first Hall switch and a moving magnet that controls the on-off of the first Hall switch, wherein the moving magnet can move above the circumference where the first Hall switch is located, the first Hall switch is connected to a first light emitting group, and an output of the first Hall switch is connected to a second light emitting group through a control switch. The control switch is an MOS transistor and the output of the first Hall switch is connected to a gate of the MOS transistor. The color of the first light emitting group is different from that of the second light emitting group.

Through the above technical solution, the moving magnet is fixed on a knob cap of the knob, the first Hall switch and an electronic component electrically connected thereto are arranged on the same circuit board and fixed on a countertop of a household appliance such as an oven, the moving magnet can be rotated to be just above the first Hall switch when the knob cap is turned, then the first Hall switch outputs a low level and the first light emitting group is operating, and then the gate of the MOS transistor is turned off at the low level and the second light emitting group is switched off; and when an S pole of the moving magnet is away from the position directly above the first Hall switch by a certain distance, i.e. more than 3.5 mm, the first Hall switch outputs a high level, then the first light emitting group is switched off, the gate of the MOS transistor is turned on at the high level, and the LED lights in the second light emitting group emit light; and since the color of the first light emitting group is different from that of the second light emitting group, color changes can be achieved, so that users can obtain information represented by different colors.

The light emitting control circuit further includes a second Hall switch which is arranged on the same circumference as the first Hall switch, wherein the second Hall switch is electrically connected to a third light emitting group. The color of the third light emitting group is different from that of the second light emitting group. The third light emitting group includes several third LED lights connected in parallel, the second light emitting group includes several second LED lights connected in parallel, and one third LED light and one second LED light constitute a bi-colored light. The color and intensity of the third LED light and the second LED light of the bi-colored light can be adjusted by configuring resistors with different resistance values at the time of factory shipment, and a brand-new color can be formed as a third color by mixing, thereby enabling color indications of different states of turnoff, slow fire and strong fire.

Through the above technical solution, a second Hall switch is added, which can enable three-color conversion, e.g. the S pole of the moving magnet is turned to a middle position of the second Hall switch and the first Hall switch, both the second Hall switch and the first Hall switch are not turned on due to no field intensity received, and only the second light emitting group is operating; and when the S pole is turned to be just above the second Hall switch, both the second light emitting group and the third light emitting group are operating; and since the LED light of the third light emitting group electrically connected to the second Hall switch and the LED light of the second light emitting group belong to the same bi-colored light, the color of the bi-colored light can be adjusted by configuring resistors with different resistance values at the time of factory shipment, e.g. the second light emitting group emits red light and the third light emitting group emits green light, and light colors such as orange and yellow can be formed by adjusting the brightness of the two emitting groups.

The first light emitting group is electrically connected to a first resistor and its luminance is controlled by the first resistor. The second light emitting group is electrically connected to a second resistor and its luminance is controlled by the second resistor. The third light emitting group is electrically connected to a third resistor and its luminance is controlled by the third resistor.

Since the color is not adjusted by a mechanical microswitch, the light emitting control circuit of the utility model has high reliability and long service life.

Figure 1:
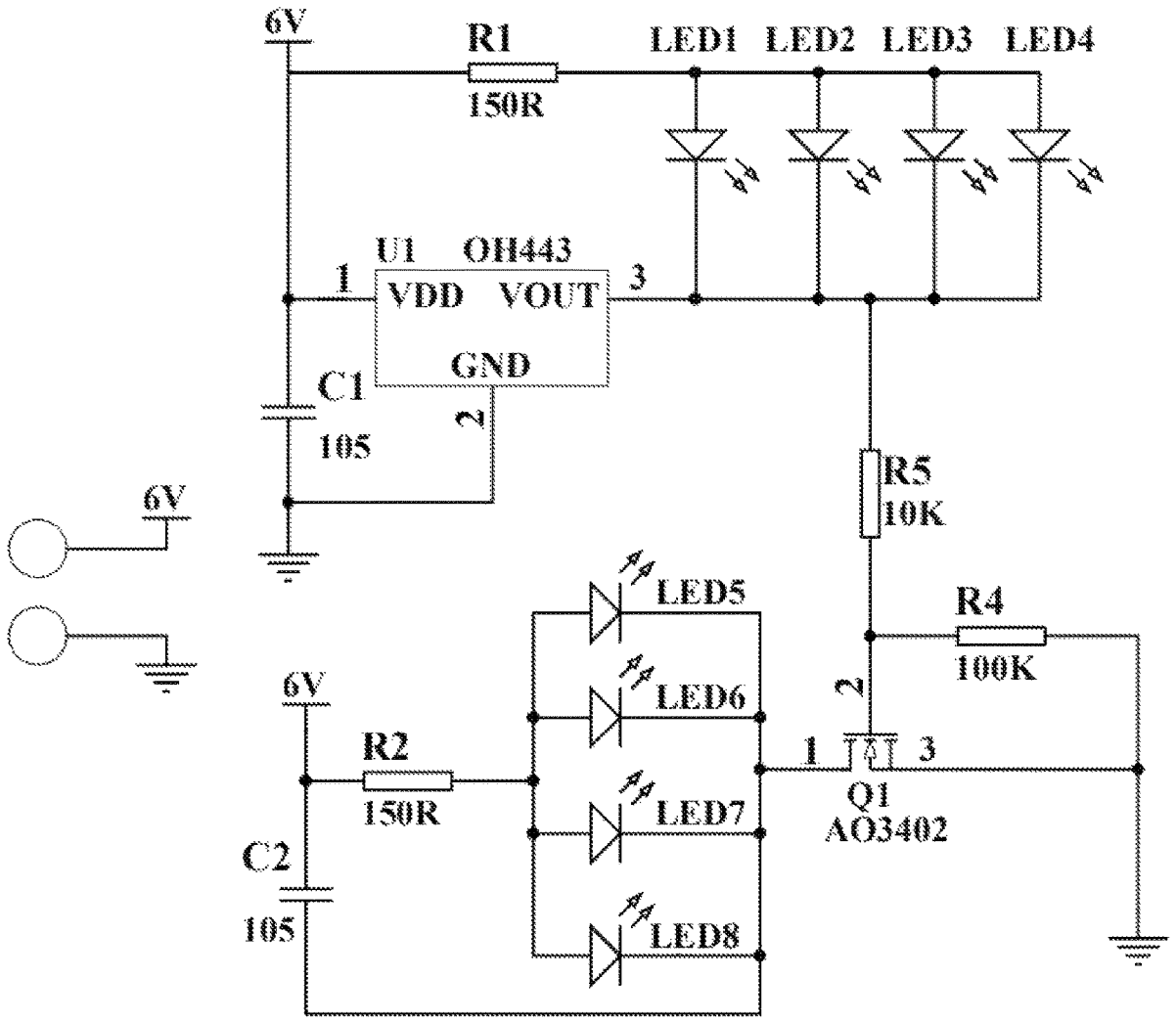
FIG. 1 is a circuit diagram of Embodiment 1 of the utility model.
Figure 2:
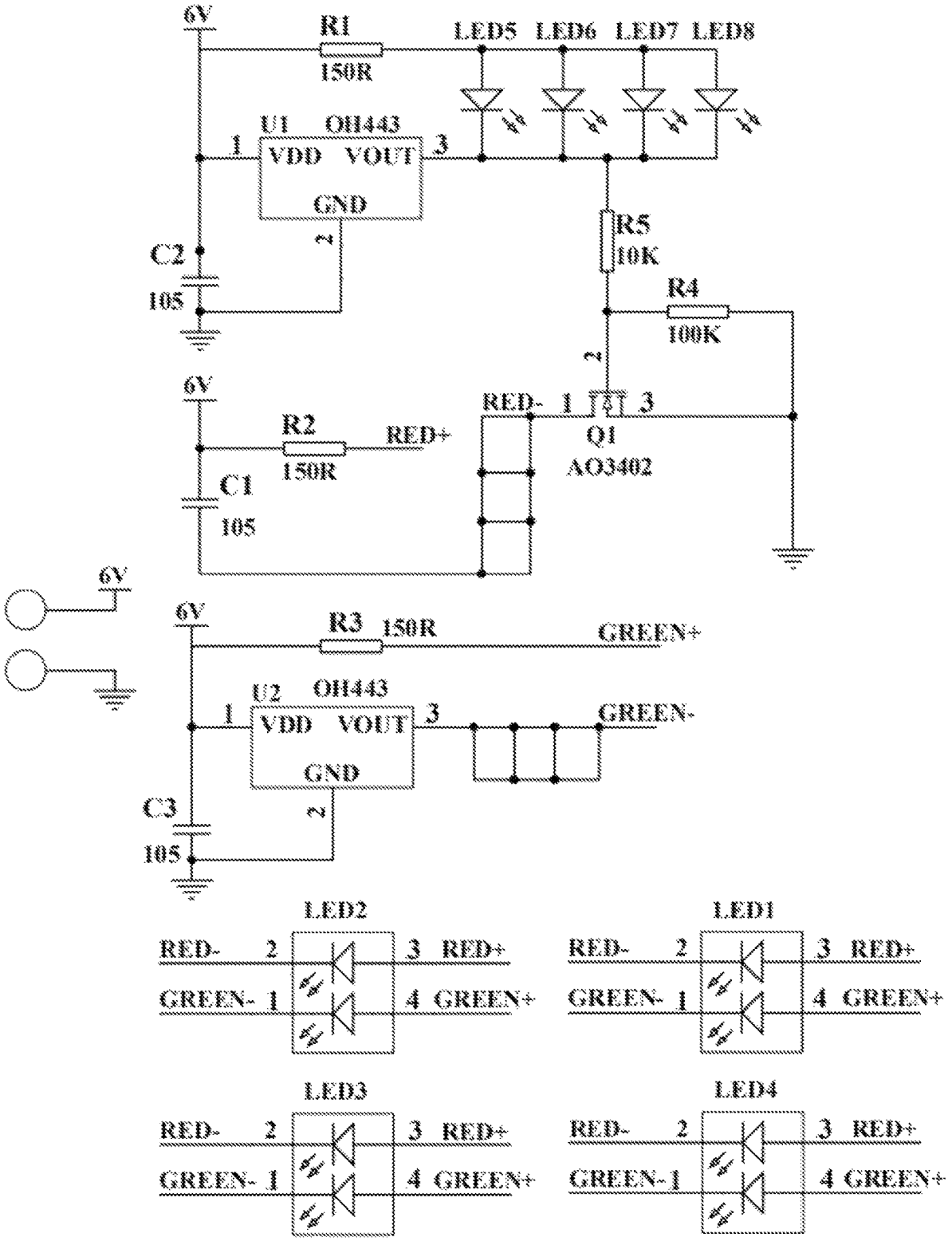
FIG. 2 is a circuit diagram of Embodiment 2 of the utility model.
Figure 3:
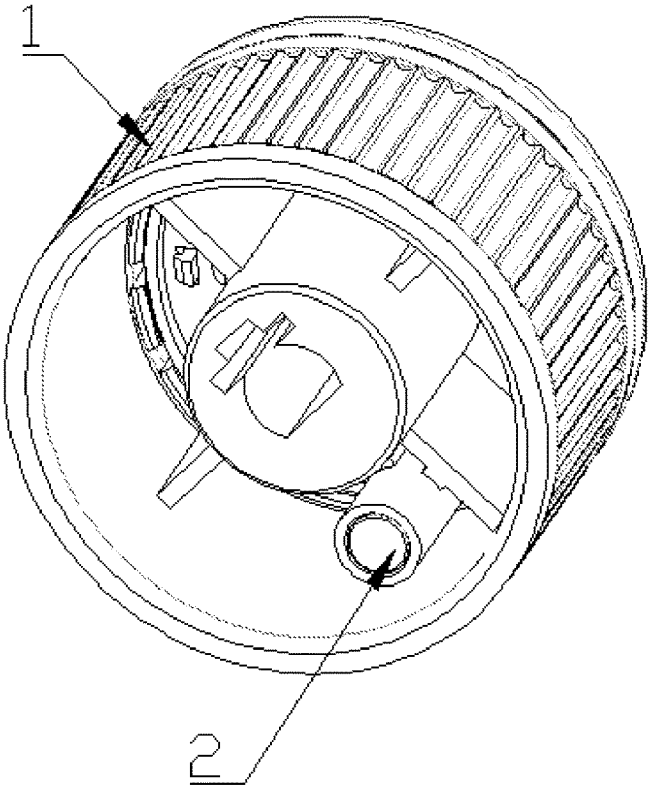
FIG. 3 is a schematic structural view of the utility model.

Reference numerals: U1—first Hall switch; R1—first resistor; R2—second resistor; R3—third resistor; Q1—MOS transistor; U2—second Hall switch; 1—knob; 2—moving magnet

DETAILED DESCRIPTION OF THE INVENTION

In order that those skilled in the art better understand the utility model to define the claimed scope of the utility model more clearly, the utility model will be described below in detail with reference to some particular embodiments of the utility model. It should be noted that the following description only refers to some particular embodiments within the concept of the utility model, which are only part of the embodiments of the utility model, wherein the detailed direct description of the related structures is only for the convenience of understanding the utility model, and various specific features do not certainly and directly define the implementation range of the utility model.

Embodiment 1: referring to FIG. 1, the utility model employs the following technical solution: a light emitting control circuit of a knob includes a first Hall switch U1 and a moving magnet 2 that controls the on-off of the first Hall switch, wherein the moving magnet can move above the circumference where the first Hall switch U1 is located, the first Hall switch U1 is connected to a first light emitting group, and an output of the first Hall switch is connected to a second light emitting group through a control switch. The control switch is an MOS transistor Q1 and the output of the first Hall switch is connected to a gate of the MOS transistor. The color of the first light emitting group is different from that of the second light emitting group. The first light emitting group includes several first LED lights connected in parallel and the second light emitting group includes several second LED lights connected in parallel. The first light emitting group is electrically connected to a first resistor R1 and its luminance is controlled by the first resistor R1. The second light emitting group is electrically connected to a second resistor R2 and its luminance is controlled by the second resistor R2.

The operating principle of this embodiment is as follows: for example, the LED lights of the first light emitting group emit white light and the LED lights of the second light emitting group emit red light. The colors used in the first light emitting group and the second light emitting group are not limited to the above colors. The above color setting is only for the purpose of providing an implementation manner, and other LED lights of different colors may also be used.

The moving magnet 2 is fixed on a knob cap of the knob 1, the first Hall switch U1 and an electronic component electrically connected thereto are arranged on the same circuit board and fixed on a countertop of a household appliance such as an oven, the moving magnet 2 can be rotated to be just above the first Hall switch U1 when the knob cap is turned, then the first Hall switch U1 outputs a low level and the first light emitting group is operating, and then the gate of the MOS transistor Q1 is turned off at the low level and the second light emitting group is switched off, i.e. white light is emitted.

When an S pole of the moving magnet 2 is away from the position directly above the first Hall switch U1 by a certain distance, the first Hall switch U1 outputs a high level, then the first light emitting group is switched off, the gate of the MOS transistor Q1 is turned on at the high level, and the LED lights in the second light emitting group emit light, i.e. red light; and since the color of the first light emitting group is different from that of the second light emitting group, color changes can be achieved, so that users can obtain information represented by different colors.

Embodiment 2: a light emitting control circuit of a knob includes a first Hall switch U1 and a moving magnet 2 that controls the on-off of the first Hall switch U1, wherein the moving magnet 2 can move above the circumference where the first Hall switch U1 is located, the first Hall switch U1 is connected to a first light emitting group, and an output of the first Hall switch U1 is connected to a second light emitting group through a control switch. The control switch is an MOS transistor and the output of the first Hall switch U1 is connected to a gate of the MOS transistor Q1. The light emitting control circuit further includes a second Hall switch U2 which is arranged on the same circumference as the first Hall switch U1, wherein the second Hall switch U2 is electrically connected to a third light emitting group. The color of the third light emitting group is different from that of the second light emitting group. The first light emitting group includes several first LED lights connected in parallel, the third light emitting group includes several third LED lights connected in parallel, the second light emitting group includes several second LED lights connected in parallel, and one third LED light and one second LED light constitute a bi-colored light. A brand-new color can be formed by selecting different resistance values for the third LED light and the second LED light of the bi-colored light at the time of factory shipment, i.e. resistors with different resistance values can be selected according to different color requirements. The first light emitting group is electrically connected to a first resistor R1 and its luminance is controlled by the first resistor R1, i.e. the first resistor R1 with different resistance values is selected to adjust the luminous intensity of the first light emitting group. The second light emitting group is electrically connected to a second resistor R2 and its luminance is controlled by the second resistor R2, i.e. the second resistor R2 with different resistance values is selected to adjust the luminous intensity of the second light emitting group. The third light emitting group is electrically connected to a third resistor R3 and its luminance is controlled by the third resistor R3, i.e. the third resistor R3 with different resistance values is selected to adjust the luminous intensity of the third light emitting group. The angle between the first Hall switch U1 and the second Hall switch U2 is preferably 180 degrees.

The operating principle of this embodiment is as follows: for example, the LED lights of the first light emitting group emit white light, the LED lights of the second light emitting group emit red light and the LED lights of the third light emitting group emit green light. The colors used in the first light emitting group, the second light emitting group and the third light emitting group are not limited to the above colors. The above color setting is only for the purpose of providing an implementation manner, and other LED lights of different colors may also be used.

An S pole of the moving magnet is rotated to be just above the first Hall switch U1, then the first Hall switch U1 outputs a low level, the second Hall switch U2 is turned off, the third light emitting group is turned off and the first light emitting group is operating, and then the gate of the MOS transistor Q1 is turned off at the low level and the second light emitting group is switched off, i.e. white light is emitted.

The S pole of the moving magnet 2 is turned to a middle position of the second Hall switch U2 and the first Hall switch U1, i.e. neither the second Hall switch U2 nor the first Hall switch U1 can receive the field intensity of the moving magnet and therefore are not turned on, and only the second light emitting group is operating, i.e. red light is emitted.

When the S pole is turned to be just above the second Hall switch U2, both the second light emitting group and the third light emitting group are operating; and since the LED light of the third light emitting group electrically connected to the second Hall switch U2 and the LED light of the second light emitting group belong to the same bi-colored light, the brightness of the two emitting groups can be adjusted by configuring resistors with different resistance values at the time of factory shipment so as to form light colors such as orange and yellow.

Figure 4:
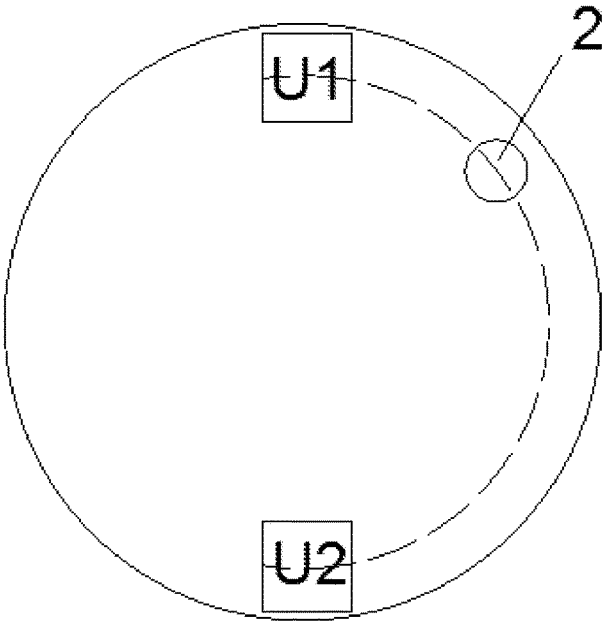
FIG. 4 a view showing the movement route of a moving magnet of the utility model.

It should be noted that the knob has a knob structure on a traditional oven, and a moving magnet is fixed on the circumference of an inner wall of the knob, wherein the dotted line in FIG. 4 is the motion trajectory of the moving magnet when the knob is moved.

The above description is not intended to limit the utility model, and the utility model is also not limited to the above examples. Changes, modifications, additions or substitutions made by those skilled in the art within the essence and scope of the utility model are also within the protection scope of the utility model.

The invention claimed is:

1. A light emitting control circuit of a knob, comprising a first Hall switch and a moving magnet that controls the on-off of the first Hall switch; the moving magnet moving above the position where the first Hall switch is located; wherein the first Hall switch is connected to a first light emitting group; and an output of the first Hall switch is connected to a second light emitting group through a control switch.

2. The light emitting control circuit of a knob according to claim 1, further comprising a second Hall switch which is arranged on the same circumference as the first Hall switch; the second Hall switch being electrically connected to a third light emitting group.

3. The light emitting control circuit of a knob according to claim 2, wherein the color of the third light emitting group is different from that of the second light emitting group.

4. The light emitting control circuit of a knob according to claim 3, wherein the third light emitting group comprising a plurality of third LED lights connected in parallel; the second light emitting group comprising a plurality of second LED lights connected in parallel; and one of a plurality of third LED light and one of a plurality of second LED light comprise a bi-colored light.

5. The light emitting control circuit of a knob according to claim 4, wherein the one of a plurality of third LED light and the one of a plurality of second LED light of the bi-colored light are respectively connected to resistors; and the intensity of the two light colors of the bi-colored light is adjusted by resistors with different resistance values so that the two light colors are mixed to adjust the color of the bi-colored light.

6. The light emitting control circuit of a knob according to claim 5, wherein the third light emitting group is electrically connected to a third resistor and its luminance is controlled by the third resistor.

7. The light emitting control circuit of a knob according to claim 3, wherein the third light emitting group is electrically connected to a third resistor and its luminance is controlled by the third resistor.

8. The light emitting control circuit of a knob according to claim 1, wherein the first light emitting group is electrically connected to a first resistor and its luminance is controlled by the first resistor.

9. The light emitting control circuit of a knob according to claim 1, wherein the second light emitting group is electrically connected to a second resistor and its luminance is controlled by the second resistor.

10. The light emitting control circuit of a knob according to claim 1, wherein the control switch is an MOS transistor.

11. The light emitting control circuit of a knob according to claim 1, wherein the color of the first light emitting group is different from that of the second light emitting group.

* * * * *